US008690155B2

(12) United States Patent
Riley

(10) Patent No.: US 8,690,155 B2
(45) Date of Patent: Apr. 8, 2014

(54) PATHOLOGY GAME AND METHOD OF PLAYING SAME

(76) Inventor: Dionne Riley, East Northport, NY (US)

( * ) Notice: Subject to any disclaimer, the term of this patent is extended or adjusted under 35 U.S.C. 154(b) by 1039 days.

(21) Appl. No.: 12/213,742

(22) Filed: Jun. 24, 2008

(65) Prior Publication Data

US 2009/0315259 A1 Dec. 24, 2009

(51) Int. Cl.
*A63F 3/00* (2006.01)

(52) U.S. Cl.
USPC ..... 273/242; 273/287

(58) Field of Classification Search
USPC ..... 273/242, 287
See application file for complete search history.

(56) References Cited

U.S. PATENT DOCUMENTS 4,136,879 A * 1/1979 Andrew et al. ..... 273/243
4,372,559 A * 2/1983 Summers ..... 273/243
5,143,378 A 9/1992 Joel
5,158,461 A * 10/1992 Sulway ..... 434/268
5,215,309 A 6/1993 Joel
5,228,860 A 7/1993 Hale
5,273,431 A * 12/1993 Charouhas ..... 434/129
5,556,100 A 9/1996 Taylor et al.
2006/0261549 A1 11/2006 Germain, III
2007/0241500 A1* 10/2007 D'Antonio ..... 273/243

* cited by examiner

*Primary Examiner* — Vishu K. Mendiratta
(74) *Attorney, Agent, or Firm* — Cahn & Samuels, LLP

(57) ABSTRACT

A pathology board game includes a colored game board comprising (a) an illustration of the human circulatory system comprising organs and limbs; and (b) a colored circle or wheel comprising a plurality of diseases, each disease having its own number and color; a plurality of treatment/remedy cards, wherein each card comprises at least one treatment or remedy for a disease and is colored to match a corresponding disease on the colored circle; and a plurality of preventative cards, wherein each card comprises at least one preventative modality to prevent a disease and is colored to match a corresponding disease on the colored circle.

12 Claims, 21 Drawing Sheets
(20 of 21 Drawing Sheet(s) Filed in Color)

LUNG: An accumulation of fluid in the pleural sac surrounding the lung. Symptoms include difficulty breathing and pleuritic pain.
DIAGNOSTIC TESTS: Echocardiogram and CAT scan of the chest.
TREATMENT: (Pleuracentesis or Thoracentesis)
PREVENTATIVE RX: Management of ASHD and CHF.

HEART: An accumulation of fluid within the pericardial space is referred to as pericardial effusion. Symptoms include venous congestion and chest discomfort, fever, and malaise.
DIAGNOSTIC TEST: Echocardiogram
TREATMENT: Pericardiocentesis
PREVENTATIVE RX: None BRAIN: An accumulation of fluid or swelling within the brain usually caused by trauma, referred to as cerebral edema. Symptoms include seizures, altered mental status, dilated pupils, and diminished respirations.
DIAGNOSTIC TEST: CAT Scan of the head
TREATMENT: Diuretic
PREVENTATIVE RX: None LIVER: Ascites and edema occur as a result of sodium retention by the kidney and elevated hydrostatic pressure in the hepatic sinusoid.
DIAGNOSTIC TEST: CAT Scan of the abdomen
TREATMENT: Diuretics and/or paracentesis
PREVENTATIVE RX: None ARM & LEG: An accumulation of fluid (edema) in the limbs which may be secondary to poor cardiac output or diminished renal function.
DIAGNOSTIC TEST: Echocardiogram, chest x-ray
TREATMENT: Diuretic
PREVENTATIVE RX: Low salt diet, Support hose, leg elevation and exercises.

KIDNEY: Fluid retained in the bladder is caused by constriction of the urethra. Symptoms include abdominal pain and distention, urinary tract infection, and hematuria.
DIAGNOSTIC TEST: Cystogram
TREATMENT: Foley catheter or Vasodilator
PREVENTATIVE RX: None

STOMACH:

INTESTINE:

PANCREAS: Peripancreatic fluid collections are referred to as pseudo cysts, which are associated with acute pancreatitis. Symptoms include persistent pain, ascites, hemorrhage and infection.
DIAGNOSTIC TEST: CAT Scan of the abdomen
TREATMENT: Diuretic
PREVENTATIVE: None

SPLEEN:

FIG. 2

LUNG: Chronic interstitial lung disease is characterized by the presence of infiltrative material and increased edema. This produces a restrictive pulmonary function pattern leading to airway distortion and obstruction. Symptoms include difficulty breathing, cough,and clubbing of fingers.
DIAGNOSTIC TESTS: Pulmonary function test, chest X-ray, arterial blood gas, serum rheumatoid factor and antinuclear antigen.
TREATMENT: Steroids and or, immunosuppressive, cytotoxic agents or anti-fibrotic agents, and/ or lung transplant.

HEART: Pericarditis is a syndrome caused by inflammation of the pericardium. Symptoms include chest pain and heart failure secondary to tamponade.
DIAGNOSTIC TESTS: Auscultation of heart, Electrocardiogram, and (ESR) serum sedimentation rate.
TREATMENT: Steroids BRAIN: Temporal arteritis is a form of vasculitis that presents with a headache, scalp tenderness, jaw and tongue pain, vision disturbance and stroke.
DIAGNOSTIC TESTS: Serum sedimentation rate and temporal artery biopsy
TREATMENT: Steroids then NSAIDS (non-steroidal anti-inflammatory medications)

LIVER: Autoimmune hepatitis is a non-resolving inflammation of the liver of unknown etiology.
DIAGNOSTIC TESTS: Histology (plasmacytic inflammation of the portal triads), autoimmune markers, absence of viral, toxic, or alcoholic injury.
TREATMENT: Discontinuation of the offending agent and steroids.

ARMS & LEGS: Rheumatoid arthritis is a systemic disease of unknown etiology characterized by symmetric inflammation of joints.
DIAGNOSTIC TEST: X-ray of bones
TREATMENT: NSAIDS and/ or Steroids, and/ or joint replacement.

KIDNEY: Interstitial nephritis is an inflammatory process of the kidney caused by antibiotics and non-steroidal anti-inflammatory drugs. Symptoms are fever, rash and renal dysfunction
DIAGNOSTIC TESTS: Serum eosinophilia and eosinphiluria.
TREATMENT: Discontinuation of the offending agent and/ or steroids.

STOMACH: Gastritis is an inflammatory process in the stomach characterized by mucosal inflammation; symptoms include gastric pain or discomfort.
DIAGNOSTIC TEST: Endoscopy
TREATMENT: Antiacids/ or NPO (No foods or beverages), IV fluids and antibiotics.
PREVENTION: Avoidance of spicy foods, or NSAIDS, steroids, alcohol and stress management.

INTESTINE: Ulcerative colitis is an idiopathic, chronic inflammatory disease of the colon and rectum, characterized by mucosal inflammation. Symptoms include bloody diarrhea, abdominal pain, and weight loss.
DIAGOSTIC TEST: Colonoscopy
TREATMENT: Anti-inflammatory agents and/ or steroids, or Immunosuppressive agents in the absence of infection or antibiotics.

PANCREAS:

SPLEEN:

FIG. 3

LUNG:

ARM: Diminished blood flow to the fingers by vasospasm of the digital arteries resulting in ischemia is known as Raynaud's disease. Symptoms include cyanotic digits, numbness and/ or tingling sensations.
DIAGNOSTIC TEST: History , physical assessment
TREATMENT: Warmth and active range of motion and/ or anticoagulant or vasodilaator.
PREVENTATIVE RX: Hand exercises, No smoking and avoiding exposure to cold.

HEART: Angina is referred to as diminished blood flow to the heart (coronary arteries). Symptoms include chest, neck, and jaw pain usually precipitated by exertion.
DIAGNOSTIC TESTS: Cardiac enzymes and thallium stress test.
TREATMENT: Oxygen, vasodilators, and rest.
PREVENTATIVE RX: Cardiac diet, exercise, no smoking or excessive drinking, stress management, and weight control.

KIDNEY: Renal hypoperfusion is due to decreased arterial blood volume. This may result from volume depletion secondary to trauma or low cardiac output secondary to heart disease.
DIAGNOSTIC TESTS: Blood tests (BUN, CREATININE ATN) and urine analysis.
TREATMENT: Volume expansion, and blood pressure support.
PREVENTATIVE RX: Cardiac diet, exercise, no smoking, or excessive drinking, stress management, and weight control.

BRAIN: (TIA) Transient ischemic attack is referred to as diminished blood flow to the brain via the carotid arteries or Circle of Willis due to plaque. Symptoms include headache, change in mental status, and gazing horizontally.
DIAGNOSTIC TESTS: CAT scan of head and MRI
TREATMENT: Antihypertensive and/ or anticoagulant drugs.
PREVENTATIVE RX: Cardiac diet, exercise, no smoking, stress management and weight control.

STOMACH: N/A
SPLEEN: N/A

LIVER: Vascular disease of the liver can be due to impaired arterial or venous blood flow such as:- Ischemic blood loss, severe burns, cardiac failure, and sepsis.
DIAGNOSTIC TESTS: Liver enzymes studies as AST, ALT, lactic dehydrogenase, and liver biopsy.
TREATMENT: Treat underlying cause if due to blood loss -treat with blood products; Severe burns- treat with IV fluids and electrolytes or blood replacement, Sepsis- treat with IV fluids blood antibiotics and maintain blood pressure.
PREVENTATIVE RX: None.

INTESTINE: Ischemic bowel (colon) disease due to diminished blood supply is known as mesenteric ischemia. Symptoms include pain, transient bleeding, diarrhea, gangrene, and perforation.
DIAGNOSTIC TEST: CAT scan, MRI and Exploratory Laparoscopy.
TREATMENT: Colon resection
PREVENTATIVE RX: None LEG: (PVD) Peripheral vascular disease is diminished blood flow to the lower extremities due to atherosclerosis. Symptoms include pain, change in skin color, numbness, and tingling sensations.
DIAGNOSTIC TEST: Angiogram
TREATMENT: Bypass graft and/ or anticoagulant
PREVENTATIVE RX: Cardiac diet, exercise, no smoking, weight control, and stress management PANCREAS: Necrotizing pancreatitis is due to diminished blood supply to the pancreas resulting in it's tissue death. Symptoms include pain, fever, and leukocyte elevation.
DIAGNOSTIC TESTS: CAT scan guided percutaneous aspiration for gram stain and culture and MRI cholangiography.
TREATMENT: Surgical debridement or Pancreatectomy
PREVENTATIVE RX: None

FIG. 4

LUNG: Loss of circulation to the lung resulting in necrosis. Symptoms include pain, difficulty breathing, and fatique.
DIAGNOSTIC TEST: CAT Scan of chest.
TREATMENT: Surgical debridement
PREVENTATIVE RX: None

CARDIAC: Death of tissue in the heart resulting from no blood flow causing lack of oxygen to the tissue.
DIAGNOSIC TEST: MUGA scan
TREATMENT: Bypass graft or PTCA and/ or medications (Ca Channel/ Beta blockers and anticoagulants), and morphine sulfate.
PREVENTATIVE RX: Management of ASHD (atherosclerosis) and/ or HTN (hypertension) or Exercise, cardiac diet and stress management.

BRAIN: Loss of blood flow to the brain resulting in CVA (cerebral vascular accident). Symptoms include aphasia, loss of cognitive and motor functions.
DIAGNOSTIC TEST: MRI with or without contrast
TREATMENT: Restoration of circulation anticoagulant, and/ or carotid endarterectomy.
PREVENTATIVE RX: Management of ASHD (atherosclerosis) and HTN (hyprtension)

LIVER:

ARM & LEG: Gangrene occurs when a body part loses it's blood supply. The tissue becomes necrotic. Signs and symptoms are discoloration darkening of tissue, loss of sensation, and foul odor may be present.
DIAGNOSTIC TEST: Serum CBC, CAT scan, tissue culture and arteriogram
TREATMENT: Improve blood supply (Bypass graft), or Surgical debridement and/ or amputation of body part.
PREVENTATIVE RX: Prompt treatment of any wound to prevent sepsis.

KIDNEY: Tubular necrosis is due to acute lack of oxygen to the tissues or presence of nephrotoxic agents, which cause particularly the kidney tubule to be is destroyed. Signs and symptoms include decreased urine output, hematuria, flank pain.
DIAGNOSTIC TESTS: Urinalysis, and serum electrolytes.
TREATMENT: Renal diet (High carborhydrate, high protein, Low sodium, and potassium) or Restoration of circulation.
PREVENTATIVE RX: Prompt treatment of condition that causes decrease blood flow.

STOMACH: Necrosis to stomach tissue results from lack of oxygen and or blood. Symptoms include abdominal pain, and discomfort.
DIAGNOSTIC TESTS: Abdominal x-ray, abdominal angiogram.
TREATMENT: Surgical debridement
PREVENTATIVE RX: Management of ASHD (atherosclerosis)
and HTN (hypertension) or restoration of circulation.

INTESTINE: Necrotizing enterocolitis causes death to the lining of the intestine due to decreased blood flow. Signs and symptoms include abdominal distention, flatus, diarrhea, and bloody stools.
DIAGNOSTIC TESTS: Abdominal X-ray, CAT scan of abdomen, stool for occult blood, serum blood test (CBC and PLT)
TREATMENT: Surgical debridement or Colon resection/ or Colostomy and/ or illeostomy.

PANCREAS: Death of tissue in the pancreas due to the interruption of it's blood supply.
DIAGNOSTIC TEST: MRI
TREATMENT: Surgical debridement or Pancreatectomy

SPLEEN: Splenic infarction is due to necrosis, death of tissue in the spleen secondary to the interruption of blood supply.
DIAGNOSTIC TEST: CAT Scan
TREATMENT: Splenectomy or Restoration of circulation.

FIG. 5

LUNG:

LEG: Stenosis of the saphenous vein will impede blood flow to the lower extremity. Symptoms include pain, diminished or absent pulse and cool extremity.
DIAGNOSTIC TEST: Doppler
TREATMENT: Anticoagulant and/or Embolectomy or Bypass graft.
PREVENTATIVE RX: Mobility HEART:(RIGHT SIDE) Stenosis of the mitral valve impedes blood flow from the lung and left atrium into the left ventricle. Symptoms include difficulty breathing, fatigue, and chest palpations.
DIAGNOSTIC TEST: Echocardiogram
TREATMENT: Antihypertensive drugs and/or anticoagulant and/ or surgery ( mitral valve replacement).
PREVENTATIVE RX: None KIDNEY: Renal artery stenosis will impede blood to the kidney resulting in renal failure. Symptoms include decreased urinary output, hypertension, and malaise.
DIAGNOSTIC TESTS: Renal sonogram, serum BUN, and creatine.
TREATMENT: Diaylsis or Bypass Graft and /or Anticoagulation
PREVENTATIVE RX: None HEART:(LEFT SIDE) Aortic stenosis is calcification or fibrosis degeneration of a normal valve. AS (aortic stenosis) is difficult to diagnose. Patients are asymptomatic for years. Symptoms are systolic murmur, difficulty breathing, angina and hypotension.
DIAGNOSTIC TESTS: Doppler Echocardiogram and cardiac catherization.
TREATMENT: Surgery (Aortic valve replacement) or Anticoagulant.
PREVENTATIVE RX: None STOMACH: Pyloric stenosis impedes the emptying of the contents of the stomach into the small intestine. Symptoms include reflux nausea and vomiting.
DIAGNOSTIC TEST: CAT Scan of abdomen
TREATMENT: Dilation of pyloric stenosis.
PREVENTATIVE RX: None BRAIN: Stenosis of the carotid arteries leading to the brain is called carotid stenosis. Symptoms are similar to stroke, one sided weakness or paralysis to one side, impaired speech and blindness.
DIAGNOSTIC TESTS: Doppler studies of the carotid arteries and CAT scan of the head.
TREATMENT: Carotid Endarterectomy and/ or Anticoagulant
PREVENTATIVE RX: Management of HTN (hypertension), and ASHD (atherosclerosis).

INTESTINE: Stenosis of the intestine will prevent contents of the intestine from leaving the colon. Symptoms include nausea, vomiting, and abdominal pain.
DIAGNOSTIC TEST: CAT scan of abdomen
TREATMENT: Colon resection
PREVENTATIVE RX: None ARM: Stenosis of the brachial vein will impede blood flow to the arm. Symptoms include pain, diminished or absent of radial pulse, and cool extremity.
DIAGNOSTIC TEST: Doppler
TREATMENT: Embolectomy and/ or Anticoagulantion
PREVENTATIVE RX: Active Range of motion

PANCREAS:
LIVER:
SPLEEN:

FIG. 6

LUNG: Cystic fibrosis (an autosomal-recessive disorder related to abnormal electrolyte transport in the airway) results in dessicated airway secretions and mucociliary clearance. Secretions become infected and airway obstruction results.
DIAGNOSTIC TESTS: Clinical and family history, genotype, elevated sweat chloride, Chest x-ray and CF (cystic fibrotic) mutations.
MANAGEMENT: Deep breathing and coughing exercises, oxygen, vaccinations, bronchodilators, steroids, antibiotics, and/ or lung transplant.
PREVENATIVE RX: Prevent respiratory infections.

HEART: Cardiomyopathy is a heart disorder characterized by ventricular hypertrophy, diminished left ventricular cavity not associated with hypertension. This may be a form of a mutation. Symptoms include difficulty breathing, chest pain, and cardiac failure.
DIAGNISTIC TESTS: Chest x-ray, and Echocardiogram.
MANAGEMENT: Diuretic and Antihypertensive drugs.

BRAIN: Hydrocephalus is an accumulation of cerebrospinal fluid in the ventricles of the brain, leading to enlargement and swelling. Symptoms vary depending on cause of obstruction to cerebral spinal fluid circulation. Infants with hydrocephaleis have bulging fontanelles and head enlargement.
DIAGNOSTIC TESTS: CAT scan of head, Tran-illumination, skull x-ray, Encephalogram, and lumbar puncture.
MANAGEMENT: Ventriculoperitoneal shunt LIVER: Wilson's disease is a progressive ( uniformly fatal) recessive disorder of copper metabolism that may present with FHR but presents with hepatic dysfunction accompanied by neuropsychiatric disorder.
DIAGNOSTIC TESTS: Serum copper levels, Liver biopsy and 24 hour urine for copper.
MANAGEMENT: Copper-chelating agent or Liver transplant.

ARMS & LEGS: Cerebral palsy syndromes are a group of motor disorders characterized by impaired voluntary movement of the arms, legs, head and torso. These disorders occur during fetal development. Symptoms include abnormal movements of the upper/ lower extremities and sometimes seizures..
DIAGNOSTIC TESTS: Cranial CAT scan, Eye and Orbit Ultrasound, RHSA Scan, and (CSF) Cerebral spinal fluid collection.
MANAGEMENT: Ventriculoperitoneal Shunt KIDNEY: Glomerular disease may be primary or secondary to a systemic process and may be present with isolated hematuria or proteinuria or nephritic syndrome.
DIAGNOSTIC TEST: Renal biopsy.
MANAGEMENT: Diuretics, Anti-hypertensive drugs, Statin drugs, and dietary modifications (low potassium, sodium and protein restriction).

STOMACH:

INTESTINE: Celiac Sprue is a celiac disease in which patients are sensitive to gluten or a group of proteins present in wheat, barley, and rye.
DIAGNOSTIC TESTS: Biopsy of intestine; presence of antigliadin and antiendomysiol antibodies.
MANAGEMENT: Wheat free diet PANCREAS: Type I diabetes occurs in infants/ and children. It is due to an immuno-mediated destruction of insulin producing cells.
DIAGNOSTIC TESTS: Fasting blood sugar and C protein.
MANAGEMENT: Insulin therapy.

SPLEEN:

FIG. 7

LUNG: A bacterial infection of the lung is referred to as pneumonia. Symptoms are cough, expectoration of phlegm, fever, malaise, and loss of appetite.
DIAGNOSTIC TESTS: Chest x-ray or CAT scan of chest.
TREATMENT: Antibiotic
PREVENTATIVE RX: Pneumovaccine CARDIAC: A bacterial infection of the heart is known as Endocarditis. Symptoms are fever and weight loss.
DIAGNOSTIC TEST: Blood culture and echocardiogram
TREATMENT: Antibiotic
PREVENTATIVE RX: Prophylactic antibiotics prior to dental work.

BRAIN: A bacterial infection of the brain is called encephalitis. Symptoms include change in mental status, fever and stiff neck.
DIAGNOSTIC TESTS: Blood cultures and spinal tap.
TREATMENT: Antibiotic
PREVENTATIVE RX: Consult your physician if you experience flu-like or cold symptoms greater than one week.

LIVER: A bacterial infection of the liver is referred to as hepatitis. Hepatitis A is transmitted via fecal and oral route and large scale- outbreaks are due to contamination of food and water. HEPATITIS B is spread via blood transfusion, sexual intercourse, and contaminated needles.
DIAGNOSTIC TEST: Elevated Liver Enzymes.
TREATMENT: Antibiotics.
PREVENTATIVE RX: Hepatitis B; Protected sex, autologus blood transfusions, retractable and disposable syringes and Hepatitis B vaccine. Hepatitis A; Meticulious hand washing.

ARM AND LEG: A bacterial infection of the soft tissue is referred to as cellulitis. Symptoms include redness, swelling, warmth, fever and drainage.
DIAGNOSTIC TESTS: Visual observation, palpation of skin, and elevated serum white blood cells (WBC).
TREATMENT: Antibiotic
PREVENTATIVE RX: Clean wounds normal saline then apply dry sterile dressings.

KIDNEY: A bacterial infection of the kidney is referred to as pyelonephritis. Symptoms include fever, flank pain, pyuria, and frequent urination.
DIAGNOSTIC TEST: Renal Sonogram
TREATMENT: Antibiotic
PREVENTATIVE RX: Adequate hydration.

STOMACH: Helicobacter pyloris is a bacterial infection associated with peptic ulcer disease. Patients are usually asymptomatic.
DIAGNOSTIC TEST: Endoscopic biopsy for urease assay.
TREATMENT: Antibiotic
PREVENTATIVE RX: None INTESTINE: A bacterial infection of the intestine is referred to as diverticulitis. Typical symptoms include lower abdominal pain, fever chills, and altered bowel habits.
DIAGNOSTIC TEST: Imaging studies (CAT scan with Hypaque enema)
TREATMENT: Mild diverticulitis: Low residue diet and Antibiotics. Moderate diverticulitis: NPO, IV fluids, Antibiotic and Surgical Consultation.
PREVENTATIVE RX: Low residue diet.

PANCREAS: A bacterial infection of the pancreas is referred to as pancreatitis. It may be acute or chronic. Symptoms include nausea, vomiting, fever, and abdominal pain.
DIAGNOSTIC TESTS: Serum amylase, lipase,(WBC) white blood count and Endoscopic Rectrograde Cholangio Pancreatography
TREATMENT: Pain medications, low fat diet, oral pancreatic enzyme supplement and /or antibiotics.
PREVENTATIVE RX: Avoid alcohol abuse.

SPLEEN:

FIG. 8

LUNG: TRAUMATIC PNEUMOTHORAX- is a collection of air in the pleural space resulting from a traumatic injury to the chest, a penetrating stab wound, gun shot, or blunt injury as in a car crash..
DIAGNOSTIC TEST: Chest x-ray
TREATMENT: Chest tube and oxygen
PREVENTATIVE RX: Use of seat belt; Avoid physical violence, and guns.

HEART: Trauma to the heart may cause compression of the heart muscle causing fluid accumulation in the space between the muscle of the heart and outer covering sac of the heart. This is referred to as cardiac tamponade.
DIAGNOSTIC TESTS: Chest x-ray, and Echocardiogram
TREATMENT: Pericardiocentesis
PREVENTATIVE RX: Seat belt; Protective chest gear; avoid physical violence.

BRAIN: A collection of fluid, usually blood, on the surface of the brain is referred to as a subdural hematoma and usually results from a head injury. Symptoms include a change in mental status, nausea, vomiting and seizures.
DIAGNOSTIC TESTS: CAT scan of head or MRI
TREATMENT: Diuretics and/ or anticonvulsant medication, or evacuation of subdural hematoma (craniotomy).
PREVENTATIVE RX: Helmet, Fall precautions (proper shoes and ambulatory devices) and use of seat belts.

LIVER: Injury to retroperitoneum occurs with blunt or penetrating trauma to the liver. Symptoms include abdominal pain.
DIAGNOSTIC TESTS: CAT scan of abdomen or MRI
TREATMENT: Surgical repair of laceration.
PREVENTATIVE RX: Avoid physical violence and use of seat belts.

ARM & LEG: A traumatic amputation is the loss of a body part that occurs as a result of an accident. Symptoms include pain, hemorrhage, body part partially or completely severed
DIAGNOSTIC TESTS: Visual observation
TREATMENT: Surgery to re-attach limb or amputation or surgical repair of lacerations.
PREVENTATIVE RX: Seat belt; Avoidance of violence.

KIDNEY: Injury caused by blunt trauma to the kidney. Symptoms include abdominal pain and discomfort.
DIAGNOTIC TEST: CAT scan of abdomen
TREATMENT: Nephrostomy or Surgical repair of lacerations.
PREVENTATIVE RX: Seat belt or avoid violence.

STOMACH: Injury that occurs with blunt or penetrating trauma to the stomach. Symptoms include abdominal pain and/ or discomfort.
DIAGNOSTIC TEST: CAT scan of abdomen
TREATMENT: Surgical repair of lacerations.
PREVENTATIVE RX: Seat belt or avoid violence INTESTINE: Injury to the retroperitoneum occurs with blunt or penetrating trauma to the intestine. Symptoms of blunt trauma include pain, discomfort, and penetrating trauma; and symptoms of shock.
DIAGNOSTIC TEST: CAT scan of the abdomen
TREATMENT: Colon resection or surgical repair of lacerations
PREVENTATIVE RX: Seat belt, Avoid violence PANCREAS: Injury to the retroperitoneum occurs with blunt and or penetrating trauma to the pancreas. Symptoms include abdominal pain.
DIAGNOSTIC TEST: CAT scan of abdomen
TREATMENT: Surgical repair of pancreas or pancreatectomy.
PREVENTATIVE RX: Seat belt, Avoid or restrain from violence.

SPLEEN: Injury to the retroperitoneum occurs with blunt or penetrating trauma to the spleen. Symptoms include abdominal pain.
DIAGNOSTIC TEST: CAT scan of abdomen
TREATMENT: Splenectomy
PREVENTATIVE RX: Seat belts and avoidance of violence.

FIG. 9

LUNG: Viral pneumonia is an inflammation of lungs caused by H. influenzae, or respiratory syncytial virus. Symptoms include cough, headache, fever, chills, and aches.
DIAGNOSTIC TESTS: Chest X-ray, and viral serology
TREATMENT: Antiviral medications, hydration and rest.
PREVENTATIVE RX: Flu vaccination CARDIAC: Dilated cardiomyopathy is a heart weakened by a virus which cannot pump efficiently.
Signs & symptoms are difficulty breathing, fatigue, and decreased urine output.
DIAGNOSTIC TESTS: Echocardiogram, chest-x-ray, and nuclear heart scan (MUGA)
TREATMENT: Diuretics, ACE inhibitors, antiarrhythmics, beta blockers, and cardiac glycoside.
PREVENTATIVE RX: None BRAIN: Haemophilus influenzae meningitis is an infection of the membranes covering the brain/spinal cord which is caused by a virus. Signs & symptoms headache, fever, stiff neck, and nausea and vomiting .
DIAGNOSTIC TESTS: Viral serology, blood cultures, and physical assessment.
TREATMENT: Fluid and electrolyte replacement.
PREVENTATIVE RX: None LIVER: Viral hepatitis is an inflammatory irritation and swelling of the liver caused by Hepatitis A virus. Symptoms include fatigue, jaundice, nausea, vomiting, fever, clay colored stools, and dark urine.
DIAGNOSTIC TESTS: Serology test IgM, IgG, antibodies elevated liver enzymes.
TREATMENT: Rest, avoidance of alcoholic beverages and fatty foods.
PREVENTATIVE RX: Eat in sanitary conditions; meticulous hand washing.

ARM & LEG: Arthritis may be a symptom of many viral illnesses such as rubella and human parvovirus. Symptoms include joint pain with swelling.
DIAGNOSTIC TESTS: Physical exam for joint swelling, Serology for viral agent.
TREATMENT: Pain relievers, aspiration of fluid from joints.
PREVENTATIVE RX: None

KIDNEY:

STOMACH: Norwalk or retavirus causes inflammation of the stomach/ intestine. Symptoms include diarrhea, dehydration, weight loss, vomiting, and generalize aches.
DIAGNOSTIC TEST: Stool assays
TREATMENT: Fluid and electrolyte replacement.
PREVENTATIVE RX: None INTESTINE: Retrovirus causes inflammation of the lining of the intestine. Symptoms include diarrhea, dehydration, nausea, vomiting, and abdominal cramps.
DIAGNOSTIC TEST: Stool assay
TREATMENT: Fluid and electrolyte replacement.
PREVENTATIVE RX: Scrupulous hand washing

PANCREAS:

SPLEEN:

FIG. 10

LUNG: Pulmonary thrombus is the interruption of blood supply to the pulmonary artery resulting in poor gas exchange. Symptoms include shortness of breath, and respiratory collapse.
DIAGNOSTIC TESTS: Echocardiogram, CAT scan of chest, (TEE) Transesophageal echocardiogram, and Ventilation-Quadrant Scan.
TREATMENT: Anticoagulant or Pulmonary Thrombectomy
PREVENTATIVE: None LEG: A thrombus in the saphenous vein causes an interruption in the blood supply to the leg and is referred to as a deep vein thrombus (DVT).
DIAGNOSTIC TESTS: Doppler studies.
TREATMENT: Anticoagulant
PREVENTATIVE RX: Mobility HEART: A heart attack results from an atherosclerotic plaque rupture and subsequent formation of an occlusive coronary thrombus. Symptoms may include chest, jaw, and back pain.
DIAGNOSTIC TESTS: Serum cardiac enzymes, troponin levels and EKG.
TREATMENT: Aspirin, nitroglycerin, anticoagulant, Beta-blockers and morphine sulfate or Thrombolytics (TPA)
PREVENTATIVE: Exercise, cardiac diet, Stress and hypertension management.

KIDNEY: Renal thrombosis occurs in chronic kidney disease. It is an interruption of blood supply to the renal vein due to a thrombus or plaque formation. Symptoms include decreased urinary output and HTN.
DIAGNOSTIC TESTS: Serum BUN, creatine and arterial sonogram.
TREATMENT: Antihypertension medication and/or Thrombectomy
PREVENTATIVE: Management of atherosclerosis.

BRAIN: A stroke is the interruption of vascular supply to a certain region of the brain due to thrombus or plaque formation. Symptoms include one sided weakness, paralysis, slurred speech, altered mental status, and impaired vision.
DIAGNOSTIC TESTS: CAT scan of head and MRI.
TREATMENT: Anticoagulant and/or Carotid Endarterectomy and or Thrombolytics (TPA)
PREVENTATIVE: Exercise, cardiac diet, Stress and hypertension management.

STOMACH:

LIVER: Portal vein thrombosis is seen in a variety of clinical settings, abdominal trauma, cirrhosis, malignancy, infections, pancreatitis after portal shunt surgery.
DIAGNOSTIC TEST: Ultrasonographic Doppler
TREATMENT: Anticoagulant
PREVENTATIVE: Safety precautions, Management of underlying disease factors.

INTESTINE: Mesenteric thrombosis is an interruption or reduction of blood supply in the celiac or superior mesenteric arteries. Symptoms include diffuse abdominal pain then constant, colicky pain, nausea, and vomiting.
DIAGNOSTIC TESTS: Abdominal films, barium studies, celiac and mesenteric angiography.
TREATMENT: Colon resection
PREVENTATIVE RX: Management of atherosclerosis ARM: A thrombus in the brachial artery causes an interruption of blood supply to the arm. Symptoms may include altered sensation to the arm, pain and change in color.
DIAGNOSTIC TEST: Doppler studies
TREATMENT: Brachial Thrombectomy and/ or anticoagulant.
PREVENTATIVE RX: Management of ASHD

PANCREATIC: NA
SPLEEN: NA

FIG. 11

LUNG:

KIDNEY:

HEART: ASHD (atherosclerosis) is plaque along the vessels narrowing the lumen that supplies blood to the heart. Symptoms include intermittent chest discomfort and/ or shortness of breath
DIAGNOSTIC TESTS: Stress test and Angiogram
TREATMENT: Anticoagulant, PTCA, CABG
PREVENTATIVE RX: Management of ASHD (atherosclerosis and/ or hypertension or Cardiac diet, stress management, and exercise.

STOMACH:

BRAIN: Plaque along the cerebral arteries leads to cerebral atrophy. Symptoms include unilateral weakness and/ or slurred speech.
DIAGNOSTIC TEST: CAT scan of the head
TREATMENT: Anticoagulant, Thrombolytics or Carotid endarterectomy
PREVENTATIVE RX: Management of ASHD (atherosclerosis) and/or hypertension or Cardiac diet, exercise and stress management.

SPLEEN:

LIVER: Non-alcoholic steatohepatitis is a build up of fatty tissue in the liver. Build up of fat causes inflammation of the liver which can lead to symptoms such as fatigue, weight loss, and weakness.
DIAGNOSTIC TESTS: CAT scan of the abdomen, abdominal ultrasound, and MRI.
TREATMENT: None
PREVENTATIVE RX: Cardiac diet, exercise and stress management.

INTESTINES:

ARM & LEG: Lipoma is a growth of fat cells found below the skin. Asymptomatic
DIAGNOSTIC TEST: Palpation
TREATMENT: Surgical incision
PREVENTATIVE RX: None

PANCREAS:

FIG. 12

LUNG CANCER: A malignant neoplasm of the lung marked by an uncontrolled growth and spread of abnormal cells. Pulmonary neoplasms, are characterized by difficulty breathing, cough, bloody sputum, fever, and malaise.
DIAGNOSTIC TESTS: Chest x-ray & CAT scan of lung
TREATMENT: Removal of part of the lung (lobectomy) and/or Chemotherapy, and/or radiation.
PREVENTATIVE RX: Avoid smoking, Asbestos and other pollutants.
Metastasizes to: Brain, Liver, and /or Bone (arm and leg)
TREATMENT FOR METASTASIS: Pain management and radiation.

HEART CANCER: (Myxoma) A rare neoplasm of the heart marked by uncontrolled growth of abnormal cells. The signs and symptoms are similar to heart disease, ie: chest pain, arrhythmias, effusions, and tamponade.
DIAGNOSTIC TESTS: Chest x-ray, CAT scan of the chest, and Echocardiogram
TREATMENT: Surgical resection of tumor or chemotherapy.
PREVENTATIVE RX: None BRAIN CANCER( EX: GLIOMA) A malignant neoplasm of the brain marked by uncontrolled growth of abnormal cells. Symptoms are weakness, speech deficits, altered mental status, headaches, and paralysis.
DIAGNOSTIC TESTS: CAT scan of the head and MRI
TREATMENT: Chemotherapy & Radiation and /or Craniotomy
PREVENTATIVE: Use cellular phone with ear piece LIVER CANCER: A malignant tumor of the liver, usually a result of metastasis from a primary site. The primary site is usually lung and breast. Symptoms are generally jaundice, altered mental status and bleeding.
DIAGNOSTIC TESTS: CAT scan of abdomen, and MRI
TREATMENT: Chemotherapy
PREVENTATIVE RX: Avoid smoking; annual mammography.
Metastasizes to: bone (leg and/ or arm)
TREATMENT FOR METASTASIS: Pain management ARM & LEG CANCER (Sarcoma): A malignant tumor of the arm or leg that arises from soft tissue or bone. Symptom is generally a lump. Pain is usually detected when the tumor grows and presses on neighboring organs.
DIAGNOSTIC TEST: CAT scan
TREATMENT: Surgical resection of the tumor
PREVENTATIVE: None
Metastasizes to: Lung
TREATMENT FOR LUNG METASTASIS: Pain management KIDNEY CANCER: A malignant tumor of the kidney marked by abnormal cells and uncontrolled growth with spread of abnormal cells. The sign is usually hematuria, (blood in the urine).
DIAGNOSTIC TESTS: CAT scan of the kidney and MRI.
TREATMENT: Surgical resection of tumor or chemotherapy only if cancer is not encapsulated.
PREVENTATIVE RX: None STOMACH CANCER: Gastric adenocarcinomas arise in Barrett's esophagus. Symptoms are usually vague (nausea and vomiting) and are advanced at the time of diagnosis.
DIAGNOSTIC TESTS: Endoscopy and a biopsy
TREATMENT: Gastrectomy with localized disease or Radiation.
PREVENTATIVE RX: None INTESTINAL CANCER (Colon): An adenomacarcinoma is a malignancy of the gastrointestinal system. Symptoms are bloody stools, nausea, vomiting, discomfort, and obstruction (no bowel movements).
DIAGNOSTIC TESTS: CAT scan of abdomen, MRI, and sigmoidoscopy with biopsy of polyps.
TREATMENT: Surgical resection of tumor and/or or chemotherapy. Radiation therapy is necessary if other areas are involved.
PREVENTATIVE RX: High fiber and low fat diet.

PANCREATIC CANCER: A malignant tumor located in the pancreas. Symptoms include abnormal blood sugar and other abnormal blood work.
DIAGNOSTIC TEST: CAT scan of abdomen
TREATMENT: Radiation and chemotherapy and/ or (Pancreatectomy) resection of the pancreas.
PREVENTATIVE RX: None
Metastasizes to: Liver and/ or spleen
TREATMENT FOR METASTASIS: Pain management SPLEEN CANCER: A rare malignant tumor located in the spleen. Symptoms are vague abdominal discomfort and nausea and vomiting.
DIAGNOSTIC TESTS: PET scan, CAT scan of the abdomen and MRI.
TREATMENT: Radiation or Chemotherapy
PREVENTATIVE: None

FIG. 13

HEART: Atrial fibrillation is irregular and rapid disorganized atrial activity without discrete P waves. This irregular pattern may cause emboli to go to the neighboring organs.
DIAGNOSTIC TESTS: Electrocardiogram and cardiac monitoring. (TEE) Transesoghcal echocardiogram is recommended prior to cardioversion.
TREATMENT: Cardioversion and/or Anticoagulation
PREVENTATIVE: None LOWER EXTREMITY: Deep vein thrombosis develops in lower extremities. It is the cause of 50% of pulmonary emboli in the absence of treatment. Venous thromboemboli arise from hypercoagulability and trauma to endothelial surfaces.
DIAGNOSTIC TEST: Doppler studies
TREATMENT: Anticoagulant and/ or Greenfield filter placement.
PREVENTATIVE: Mobility and /or Management of atrial fibrillation and of adequate hydration.

LUNG: Pulmonary emboli are the result of clots that dislodge or travel from the lower extremity or heart to the lung. Symptoms include difficulty breathing, chest pain, hypoxemia, pleural rub, and tachycardia. Obstruction may be fatal.
DIAGNOSTIC TESTS: Ventilation-Pertusion scan and arterial blood gas.
TREATMENT: Anticoagulant
PREVENTATIVE: Mobility, and Management of atrial fibrillation

FIG. 14

LUNG: Pulmonary eosinophilia appears to be caused by an allergic reaction. A common cause is the migration of the parasitic worm Ascaris lumbricoides through the respiratory tract.
DIAGNOSTIC TEST: Chest X-ray, Blood test reveals increase eosinophils
TREATMENT: Antiparasitic drug
PREVENTATIVES: None HEART: Trichinosis is a parasite that invades muscle tissue of the heart as a result of consuming undercooked meats. Symptoms include diarrhea, abdominal discomfort, fever, and muscle pain.
DIAGNOSTIC TEST: Serum CBC, CPK, eosinoprils, muscle biopsy.
TREATMENT: Antiparasitic drug and pain management.
PREVENTATIVES: Avoid eating meat from wild game, Cook meats thoroughly.

BRAIN: Trichinosis is a parasitic disease that invades the muscle of the brain as a result from undercooked meats. Symptoms are headaches, fever, and muscle pain.
DIAGNOSTIC TEST: CBC, CPK, eosinoprils and muscle biopsy.
TREATMENT: Analgesic & Antiparasitic drug
PREVENTATIVES: Avoid eating wild game. Cook meats thoroughly.

LIVER:

ARM & LEG:

KIDNEY:

STOMACH:

INTESTINE: An infection of the small intestine caused by protozoa, Giardia lamblia. Symptoms presents as abdominal discomfort and diarrhea.
DIAGNOSTIC TEST: Small bowel biopsy or duodenal aspirate.
TREATMENT: Antimicrobal drug
PREVENTATIVES: Protected sex. Drink treated water, Avoid exposure with those who have G.Lamblia

PANCREAS:

SPLEEN:

FIG. 15

VEIN & ARTERY

BLOOD CANCER: Leukemia is referred to as a cancer of the blood. Signs and symptoms include outlook, fatigue, anemia, and enlarged lymph nodes.
DIAGNOSTIC TEST: Bone marrow biopsy.
TREATMENT: Chemotherapy and Stem cell transplant.
PREVENTATIVE RX: None

VEIN & ARTERY

BLOOD: An accumulation of fibrous plaques, fatty deposits and lipids progressively narrowing the lumen and impeding blood flow to the major organs. Symptoms include pain, changes in sensation and color.
DIAGNOSTIC TEST: Angiogram.
TREATMENT: Anticoagulation and/or Surgical bypass, or other drugs (cholesterol drugs), PTCA
PREVENTATIVE RX: Exercise, cardiac diet, stress management and hypertension reduction.

VEIN & ARTERY

BLOOD: Necrotizing vasculitis is characterized by inflammation and necrosis of blood vessels.
DIAGNOSTIC TEST: Serum sedimentation rate
TREATMENT: Steroids and NSAIDS
PREVENTATIVE RX: None

VEIN & ARTERY

BLOOD INFECTION: Bacteremia is an infection of the blood caused by bacteria. It is also known as sepsis and may lead to septic shock.
DIAGNOSTIC TEST: Blood cultures
TREATMENT: Antibiotics
PREVENTATIVE RX: None

VEIN & ARTERY

BLOOD: A clot that travels in the blood from the leg or heart to the lungs. This is referred to as an embolus.
DIAGNOSTIC TESTS: Electrocardiogram, Venous Doppler or Ventilation perfusion scan
TREATMENT: Anticoagulation and/or Greenfield filter and/or thrombolytics
PREVENTATIVE RX: None

VEIN & ARTERY

BLOOD: Malaria is a systemic disease endemic to most of the tropical and subtropical world. This is caused by the parasite Plasmodium Vivax. Symptoms include fever, diarrhea, and cramping.
DIAGNOSTIC TEST: Blood smear
TREATMENT: Antiparasitic drug
PREVENTATIVE RX: Pre-travel advice and chemoprophylaxis. Tonic water with Quinine.

VEIN & ARTERY

BLOOD DISORDER: Von Willebrand's disease is a condition where there is a positive prolonged bleeding time. Symptoms include unexplained bruises, bleeding gums and heavy periods.
DIAGNOSTIC TESTS: Serum vWF antigen, Factor VIII and deficient plasma.
MANAGEMENT: Factor VIII concentrate
PREVENTATIVE RX: None

VEIN & ARTERY

BLOOD: Trauma to the veins or arteries can produce uncontrolled bleeding. Symptoms include signs of shock decreased blood pressure, diaphoresis, rapid pulse, pallor, and change in mental status.
DIAGNOSTIC TEST: CAT scan of trauma area
TREATMENT: Surgical repair of ruptured vessels
PREVENTATIVE RX: Safety precautions, Avoid physical violence.

FIG. 16A

VEIN & ARTERY

BLOOD: Hypercoagulation of blood is referred to as thrombocytopenia.
DIAGNOSTIC TESTS: Serum D dimer, PTT, and PT levels
TREATMENT: Anticoagulation and/ or thrombectomy
PREVENTATIVE RX: Management of ASHD

VEIN & ARTERY

BLOOD: Stenosis is the compressing of the venis vessel arteries is referred to coarctation.
DIAGNOSTIC TEST: Angiogram
TREATMENT: Anticoagulant and/ or Surgical bypass
PREVENTATIVE RX: None

VEIN & ARTERY

BLOOD: HIV is a human retrovirus that infects lymphocytes
and other cells bearing the CD4 cell marker. Over time the
immune dysfunction give rise to AIDS which is characterized
by opportunistic infections and malignancies.
DIAGNOSTIC TESTS: Serum ELISA, and Western blot
TREATMENT: Antiretroviral therapy
PREVENTATIVE RX: Protected sex and avoidance of IV drugs use. Abstinence

VEIN & ARTERY

BLOOD: Deoxinated blood flow through arteries and veins to major organs due to obstruction or heart failure leading to necrosis.
DIAGNOSTIC TESTS: Doppler and Angiogram
TREATMENT: Anticoagulant or PTCA or stents
PREVENTATIVE RX: None

FIG. 16B

AVOID SMOKING

AVOID SMOKING

STRESS MANAGEMENT

STRESS MANAGEMENT

HIGH FIBER DIET

HIGH FIBER DIET

CELLULAR PHONE WITH HEAD SET

CELLULAR PHONES WITH HEAD SET

AVOID SMOKING, ANNUAL MAMMOGRAM

AVOID SMOKING, ANNUAL MAMMOGRAM

FIG. 18

PATHOLOGY GAME AND METHOD OF PLAYING SAME

The patent or application file contains at least one drawing executed in color. Copies of this patent or patent application publication with color drawing(s) will be provided by the Office upon request and payment of the necessary fee.

I. FIELD OF THE INVENTION

This present invention relates to a pathology game and method of playing the game.

II. BACKGROUND OF THE INVENTION

There are 23 million people diagnosed with heart disease. Cancer is the second most devastating disease. Obesity has struck 1 out of 4 children which is the cause of hypertension, osteoarthritis, diabetes, coronary arteries disease, strokes, and cancer (breast and colon). Yet, many people are hesitant to seek medical advice due to fear of the unknown.

Games are a growing part of culture. For example, three quarters of children play games regularly. Games can be beneficial by promoting strategic thinking, understanding of context that is delivered, negotiating skills and data handling, communication, and exercising control over actions. Thus, games harness the desire to make learning fun and deploy rich visual and spatial aesthetics that draw players into fantasy worlds creating an exciting awe.

The purpose of the pathology game of the present invention is to teach diseases, symptoms, diagnostic testing, treatments, and preventative modalities. According to the game, players travel through the body via the circulatory system combating diseases with weapons in the form of treatments/remedies, medicine, surgery, and procedures or by deploying preventative modalities to avoid diseases. Thus, the invention teaches people about commonly-occurring diseases that affect the blood system, organs, limbs, and gives a visual look at how the circulatory system.

When such information is repeated, it is comprehended and eventually practiced. The purpose of the present invention is to educate, provide information, and promote health conscious people, thereby empowering them to make healthy choices.

III. SUMMARY OF THE INVENTION

According to the present invention a pathology board game is provided. The pathology board game includes a colored game board comprising (a) an illustration of the human circulatory system comprising organs and limbs; and (b) a colored circle or wheel comprising a plurality of diseases, each disease having its own number and color. The game also includes a plurality of treatment/remedy cards, wherein each card comprises at least one treatment or remedy for a disease and is colored to match a corresponding disease on the colored circle; and a plurality of preventative cards, wherein each card comprises at least one preventative modality to prevent a disease and is colored to match a corresponding disease on the colored circle.

According to an aspect of the present invention, a method of playing a pathology board game is provided. Each player chooses a cell for circulation throughout a human circulatory system comprising veins, arteries, and organs and illustrated on a colored game board. Each player is dealt a plurality of treatment/remedy cards and a plurality of preventative cards. During a turn, each player spins a colored circle on the colored game board, wherein the circle comprises a plurality of colored and numbered disease categories. A player advances the cell a number of spaces along the circulatory system corresponding to the number from the colored circle; and locates in a pathology booklet at least one of a treatment or prevention for the disease category for the vein, artery, or organ.

As used herein "substantially", "relatively", "generally", "about", and "approximately" are relative modifiers intended to indicate permissible variation from the characteristic so modified. They are not intended to be limited to the absolute value or characteristic which it modifies but rather approaching or approximating such a physical or functional characteristic.

In the detailed description, references to "one embodiment", "an embodiment", or "in embodiments" mean that the feature being referred to is included in at least one embodiment of the invention. Moreover, separate references to "one embodiment", "an embodiment", or "in embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

Given the following enabling description of the drawings, the system and methods should become evident to a person of ordinary skill in the art.

IV. BRIEF DESCRIPTION OF THE DRAWINGS

FIG. 2 illustrates a sheet from a pathology booklet for edema (1).

FIG. 3 illustrates a sheet from a pathology booklet for inflammation (2).

FIG. 4 illustrates a sheet from a pathology booklet for ischemia (3).

FIG. 5 illustrates a sheet from a pathology booklet for necrosis (4).

FIG. 6 illustrates a sheet from a pathology booklet for stenosis (5).

FIG. 7 illustrates a sheet from a pathology booklet for genetic (6).

FIG. 8 illustrates a sheet from a pathology booklet for bacteria (7).

FIG. 9 illustrates a sheet from a pathology booklet for trauma (8).

FIG. 10 illustrates a sheet from a pathology booklet for virus (9).

FIG. 11 illustrates a sheet from a pathology booklet for thrombus (10).

FIG. 12 illustrates a sheet from a pathology booklet for cholesterol (11).

FIG. 13 illustrates a sheet from a pathology booklet for cancer (12).

FIG. 14 illustrates a sheet from a pathology booklet for emboli (13).

FIG. 15 illustrates a sheet from a pathology booklet for parasite (14).

FIG. 16A-16B illustrates a sheet from a pathology booklet for vein and artery.

FIG. 18 illustrates the back of preventative cards showing cancer prevention labels.

V. DETAILED DESCRIPTION OF THE DRAWINGS

FIGS. 1-20 illustrate a pathology game and method of playing the same. The invention can be used in schools; for students who are aspiring to pursue careers in the health care field; for patients who want to acquire an understanding of their illness; and for inquisitive individuals who have an interest of learning about combating illness. The game is for everyone, preferably for ages 8 and up. The game may be a standard board game, video game, or virtual reality game.

A. Game Board

Figure 1:
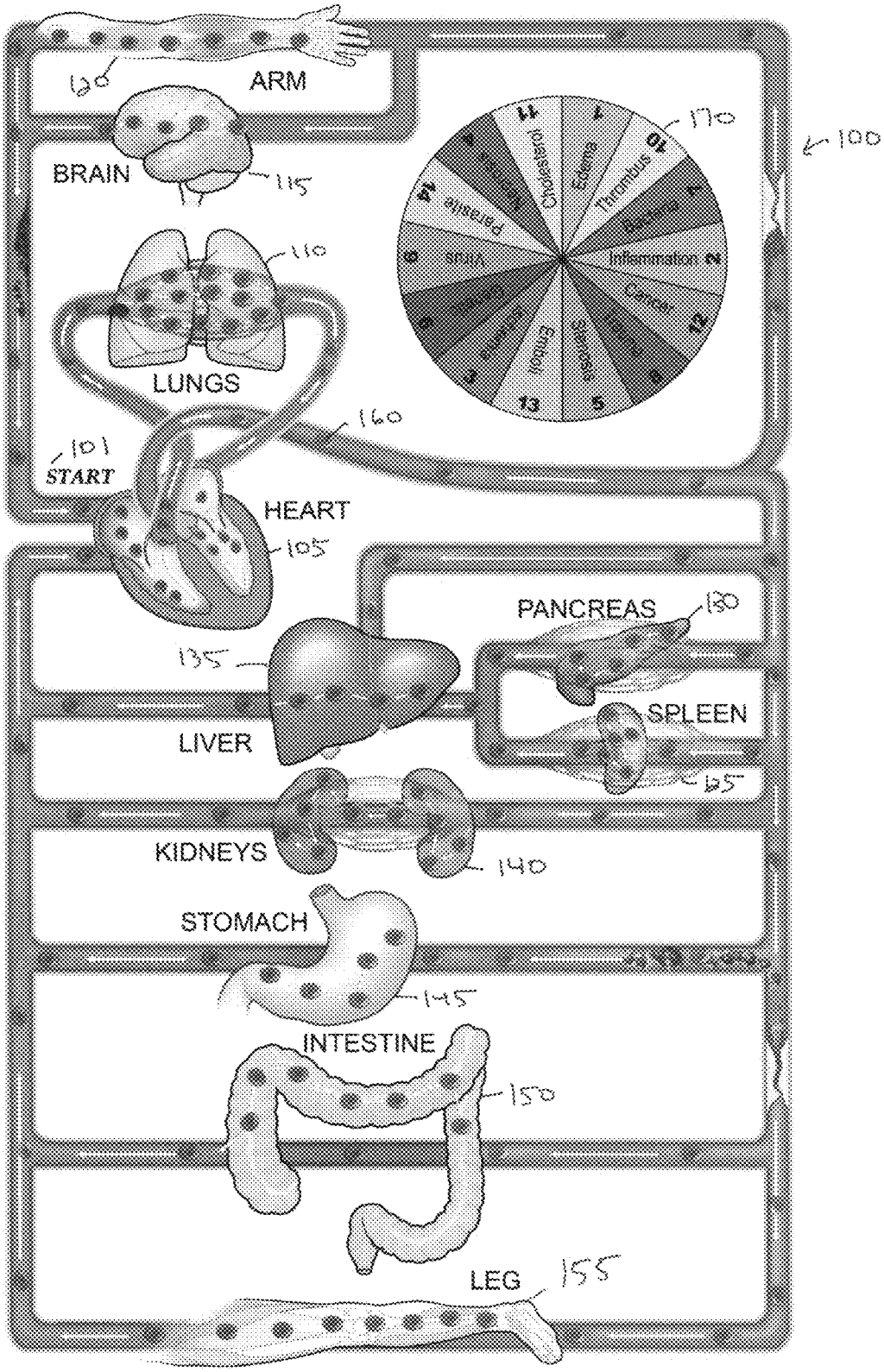
FIG. 1 illustrates a colored game board for the pathology game with a colored wheel having 14 sections according to the present invention.

FIG. 1 illustrates a colored game board 100 according to the present invention. The game board may be of any appropriate size, for example, 11×24 inches. The game board 100 comprises a schematic illustration of the human circulatory system comprising organs and limbs. In the circulatory system, oxygenated blood is red. Blood leaving organs or limbs (or entering the heart and lungs) is blue.

As shown in FIG. 1, the START for the game 101 is at the inferior or superior vena cava where blood enters into the right atrium of the heart 105. Blood passes through the right atrium into the right ventricle. The right ventricle contracts pushing blood through a valve into the pulmonary artery. The artery brings the blood to the lung 110 where carbon dioxide ($CO_2$) is exchanged for oxygen ($O_2$). Water is exhaled through the lungs. The lungs, kidneys, and skin all function to rid the body of excess waste. Oxygen rich blood returns to the left atrium via the pulmonary vein and then passes through a valve to the left ventricle. It is then forcefully ejected out through the aortic valve to the aorta to begin its travel throughout the body to deliver oxygen ($O_2$) to the cells.

The aorta is divided into three sections: (1) the aortic arch branches off supplying blood via Circle of Willis to the brain 115 and the brachial arteries to the upper extremities 120 (e.g., arm); (2) the ascending aorta supplies oxygenated blood to the coronary arteries (not shown); and (3) the descending aorta supplies oxygenated blood to the spleen 125, pancreas 130, liver 135, kidneys 140, stomach (or gastric) 145, intestine 150, and lower extremities 155 (e.g., leg).

The blood is one of the body's major fluids. Blood is made of two components: liquid (plasma) and formed components cells known as erythrocytes, leukocytes and thrombocytes, which float in the plasma. In the Pathology Game, the components of plasma and erythrocytes are used as the blood cell (i.e., spaces 160 along the circulatory system). Plasma carries antibodies and nutrients to the tissues and carries waste from the tissues. Erythrocytes, also known as red blood cells, function to carry oxygen to tissues and carbon dioxide from them.

As shown in FIG. 1, a separate colored circle or wheel 170 comprising numbers and a classification of disease categories is present on the board.

In embodiments, the disease categories or entities are as follows: edema (1) is lavender, thrombosis (10) is grey, bacteria (7) is green, inflammation (2) is orange, cancer (12) is brown, trauma (8) is dark blue, stenosis (5) is pink, emboli (13) is light blue, ischemia (3) is red, genetic (6) is plum, virus (9) is lime, parasite (14) is gold, necrosis (4) is dark grey or black, and yellow (11) is cholesterol.

B. Other Game Parts

Figure 17:
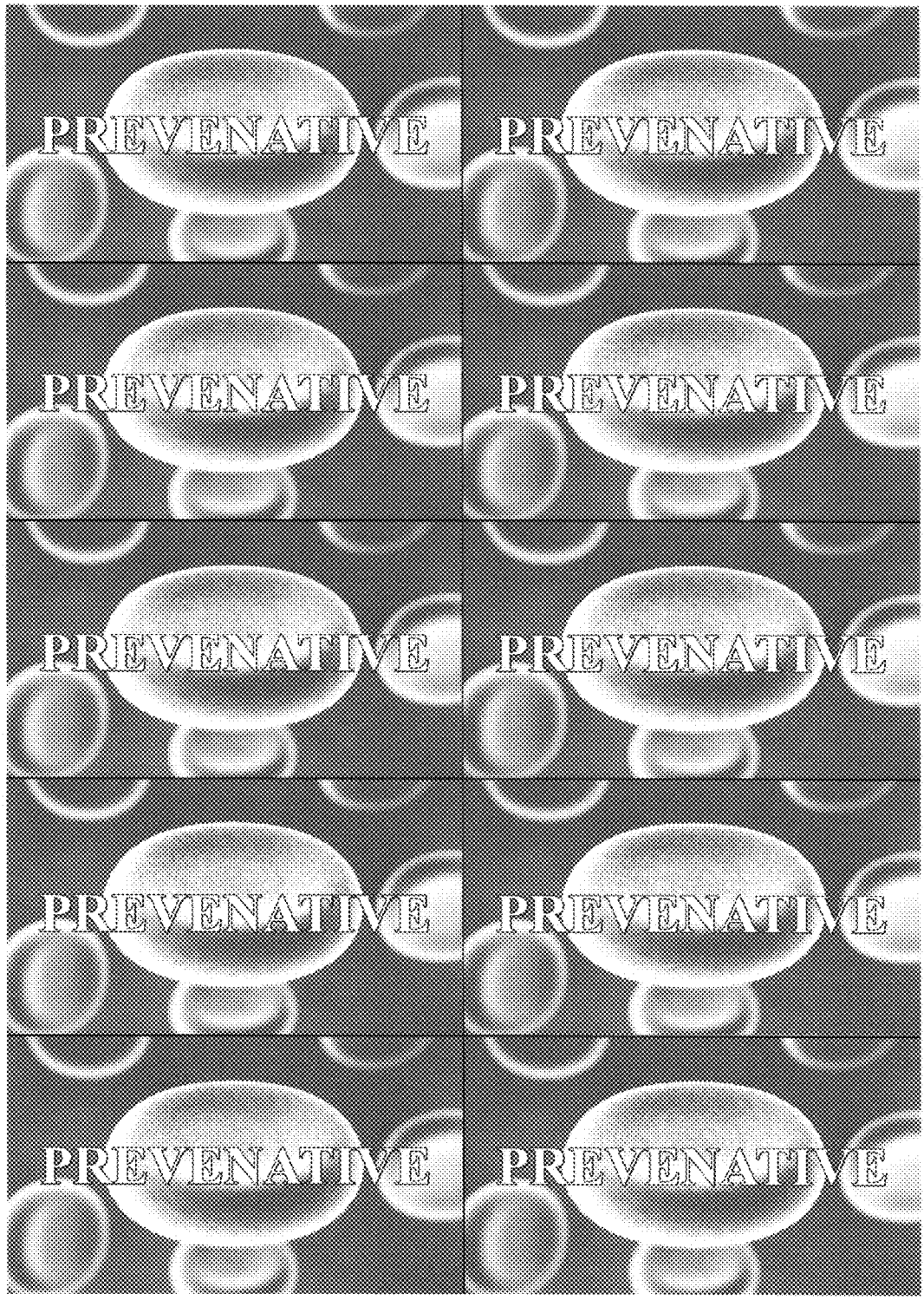
FIG. 17 illustrates a series of preventative cards.
Figure 19:
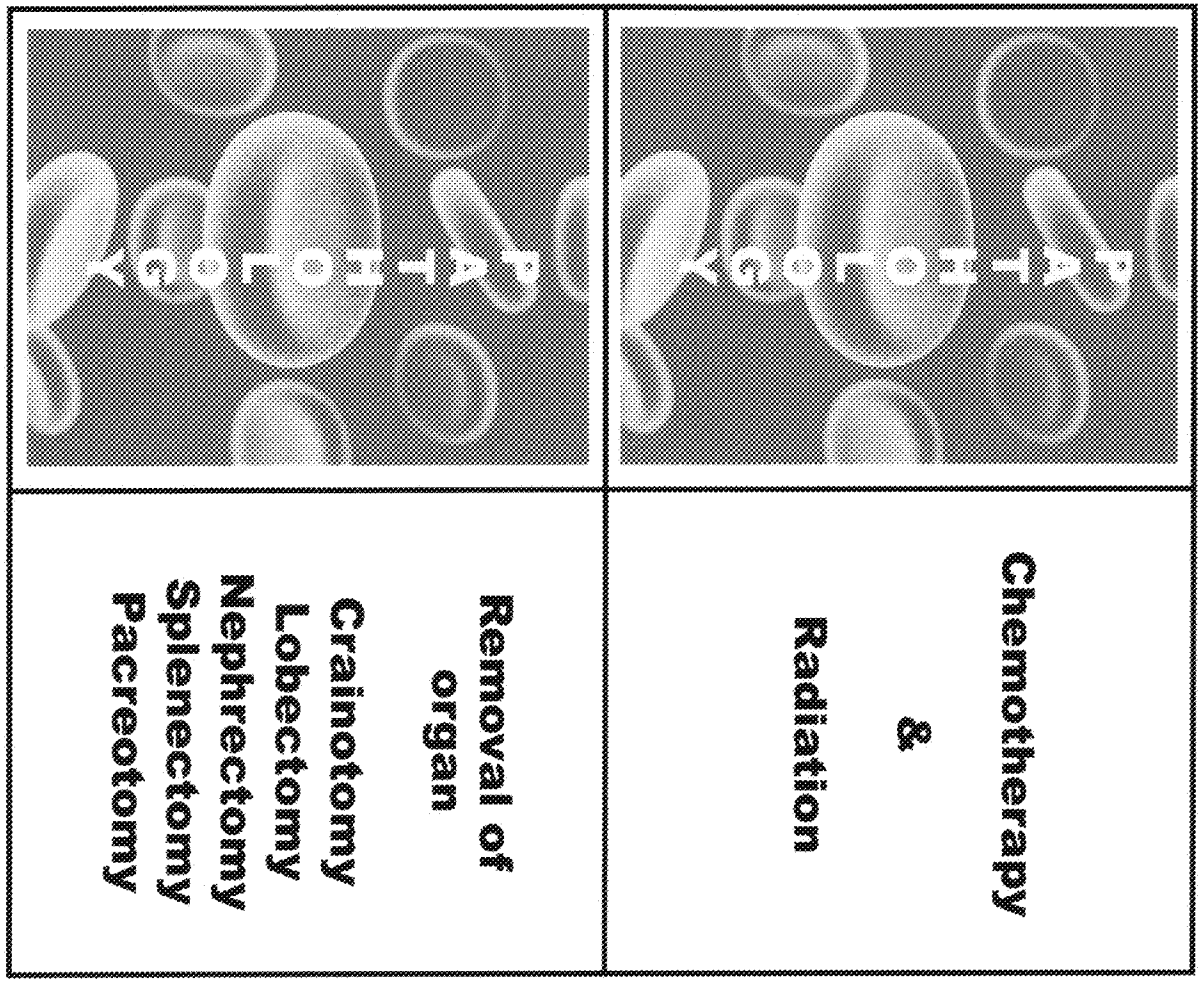
FIG. 19 illustrates two treatment/remedy cards (e.g., pathology cards) showing the front and back.
Figure 20:
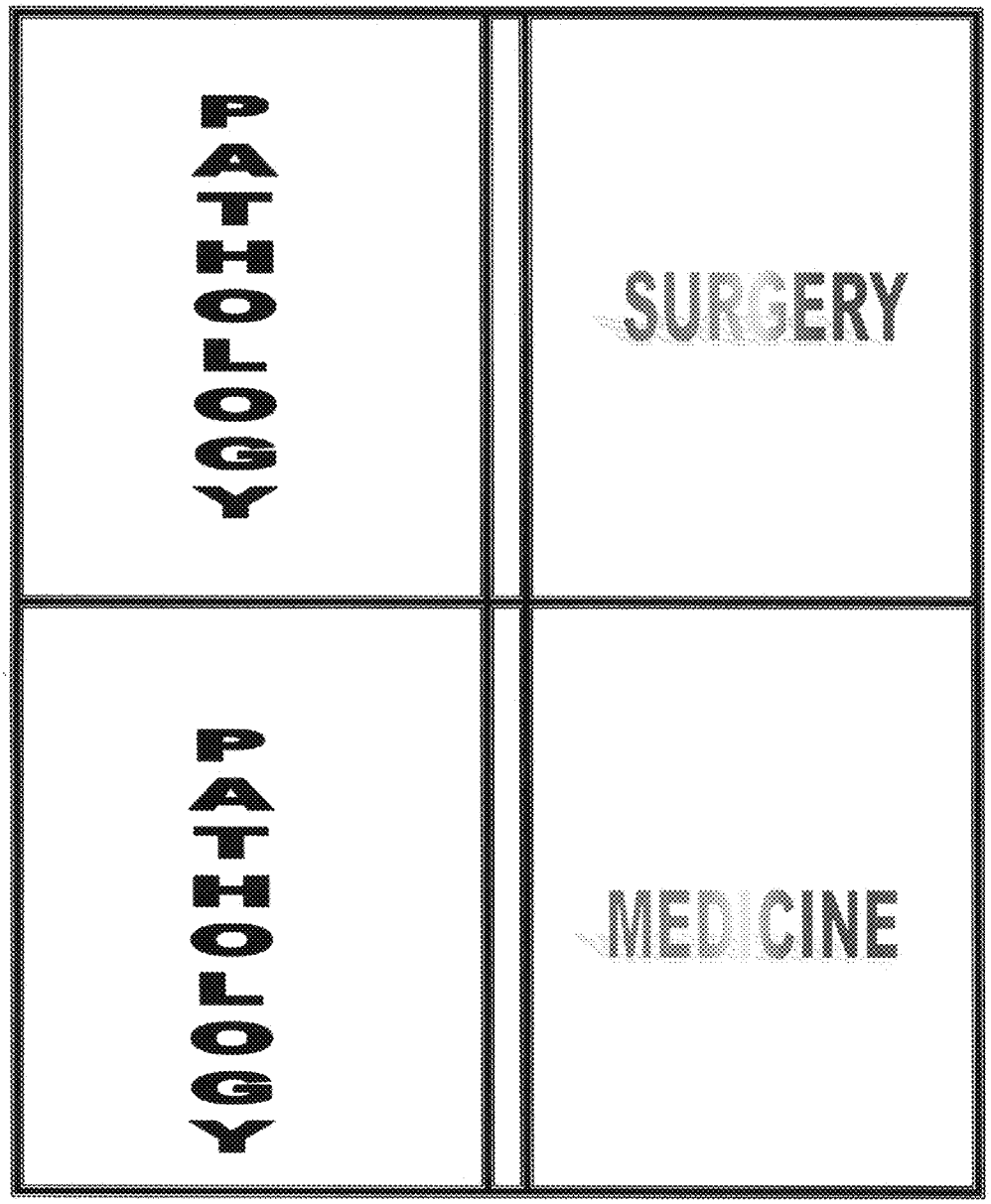
FIG. 20 illustrates two wild cards.

In addition to the game board, the pathology game also comprises:

(1) a spinner (not shown) attached to the colored circle;

(2) pathology booklets that classify diseases in the categories according to the colored wheel as illustrated in FIGS. 2-16;

(3) preventative cards (e.g., 2×4 inches) which comprise solutions to avoid, manage, and slow the progression of a disease or illness as illustrated in FIGS. 17-18;

(4) treatment/remedy cards (e.g., 3×4 inches) which comprise treatment for the diseases as illustrated in FIGS. 19-20;

(5) pegs which are used to represent each individual game player; and (6) card and peg holders (e.g., 8×2 inches).

As illustrated in FIGS. 2-16, the pathology booklets provide an explanation of each disease (1)-(14) for at least one of organs, limbs, veins or arteries; symptoms; diagnostic tests; treatment; preventative modalities; and may also comprise a glossary. An example of the Glossary is shown in the Example Glossary below. According to an embodiment of the present invention, the pathology booklet may comprise tabs that are colored coded and numbered to correspond with the number and colors on the wheel.

In embodiments, there may be 150 treatment/remedy cards, 60 preventative cards, 6 card and peg holders; and 6 pathology booklets.

C. Game Rules

In embodiments, the Pathology Game can be played with 2-6 players. Each player selects a peg, which will circulate the cardiovascular system via cells 160. Each player may be dealt (a) 16 treatment/remedy cards, comprising 13 pathology cards as illustrated in FIG. 19 and 3 wilds cards comprising 1 procedure card, 1 surgery card and 1 medicine card as discussed below and illustrated in FIG. 20 and (b) 5 preventative cards as illustrated in FIGS. 17-18.

The pathology cards comprise at least one treatment or remedy that may be printed on the back of the card. The preventative cards comprise at least one preventative modality to prevent illness or disease and may be printed on the back of the card. In embodiments, the front of the pathology cards may be red and the front of the preventative cards may be blue.

1. Spinning the Wheel and Using Cards

Each player spins the wheel 170 and moves the peg, representing a cell, the amount of spaces on the colored game board 100 that is indicated on the wheel. The color on the wheel indicates the disease entity.

For example, at the START, the wheel may be spun to the number 10 Thrombus, which is grey. A player moves his or her peg/cell ten spaces to within the vein. The player goes to the corresponding tab in the pathology booklet where the veins and arteries diseases are located (FIG. 16) and looks for the blood which will be high lighted in grey. The disease entity is called thrombocytopenia, defined as hypercoagulation of the blood. The treatment is Anticoagulation or Thrombolectomy. The preventative is Management of ASHD. Accordingly, the player may use either a treatment/remedy card (Anticoagulation) or a preventative card (Management of ASHD) to treat the disease.

As another example, the disease entity for the color brown is cancer (12). If the peg is moved to the lung when the number 12 is spun, it is referred to as lung cancer, as indicated in the sheet from the pathology booklet corresponding to cancer (FIG. 13). The treatment for lung cancer comprises chemotherapy and/or radiation or surgery. No Smoking is a preventative for lung cancer. If a player presents the preventative card (No smoking) or a treatment/remedy card (chemotherapy and radiation or surgery), the player will avoid lung cancer. In embodiments, if there is no disease for an organ or limb in the pathology booklet, the player may take an additional turn.

When a player uses a treatment/remedy card or a preventative card, the card is returned to the bottom of the respective deck of cards. The player then picks up another treatment/remedy card or preventative card. In embodiments, a player may exchange up to 5 treatment cards or preventative cards at any time during the game prior to his or her turn.

In embodiments, a player may use a multi-color treatment/remedy card or preventative card from different color categories to treat diseases of other categories. Treatment/remedy or preventative cards that can be used interchangeably will have several colors. For example, Stenosis (5), Thrombosis (10), Cholesterol (11), Emboli (13) and Ischemia (3) can all be treated with Anticoagulants. An Anticoagulant treatment card may appear in six different colors: pink, blue, grey, yellow, red, or all. The Anticoagulant treatment card may be used across different disease categories.

As other illustrative examples, embolectomy, pulmonary, arm and leg can be used in Stenosis (5) and Thrombosis (10). Bypass Graft, PTCA and Stents can be used to treat Ischemia (3), Stenosis (5), Necrosis (4), and Cholesterol (11). Joint replacement, organ replacement and removal, nephrectomy and splenectomy card may be used to treat Necrosis (4), Trauma (8), Inflammation (2) and Cancer (12). Surgical resection (colon, lobectomy, pancrotomy, nephrostomy and crainiotomy) can treat diseases of Cancer (12), Ischemia (3), Thrombosis (10), and Trauma (8). A preventative card (exercise stress reduction, low fat, and low sodium diet) can be used interchangeably for heart attacks, angina, ASHD, and CVA.

2. Moving Backwards

In the vein/artery, yellow is referred to as atheroscolosis which is a build up of plaque in the arteries; orange is inflammation and swelling; grey is a thrombus or clot; pink is stenosis which is narrowing of the vessels; and red is ischemia the narrowing of vessels secondary to anatomical changes. All these conditions will either obstruct the lumen partially or totally. These diseases will prevent blood from carrying nutrients, oxygen, or medication to the organ/limb. If a player lands on any of these diseases in the vein/artery and the player does not have the treatment/remedy, he or she must spin the wheel and move BACKWARDS the number of steps that is indicated on the wheel.

3. Cancer Spreads—Moving to a Different Organ

Cancer is known to metastasize (spread) to an adjoining area with or without treatment. Some cancers have favorite places to go (metastatic sites). Cancer may spread faster if there is a delay in treatment.

If a player lands on the following organs and does not have the remedy, he or she may not pass through that organ. Rather, the player must move the peg/cell to the organ of metastasis that is indicated below. If the player lands on:

lung—move the cell to the brain;
pancreas—move the cell to the spleen or liver;
spleen—move the cell to the liver;
liver—move the cell to the lung;
intestine—move the cell to the liver;
stomach—move the cell to the lung;
kidneys—move the cell to the liver or lung.

A player may resume the game at the metastatic site if he or she has the treatment/remedy card for metastatic treatment. If the player does not have the treatment/remedy card, he or she loses a turn. Metastatic treatment is usually palliative (e.g. radiation shrinks tumors or analgesics relieve pain) and will be on a pathology card.

4. Go to the Heart, Lung or Leg

Light blue its indicative of an embolus (13), which is a moving clot in the vessels. It will travel either to the leg, which is referred to as a deep vein thrombosis, or to the lung, which is referred to as a pulmonary embolus. Embolus originates from the heart due to an arrhythmia known as atrial fibrillation.

If a player spins the wheel to light blue (13) and lands in the heart and does not have the treatment or remedy card (e.g., cardioversion and/or anticoagulation), he or she must move the cell to the leg. If a player spins the wheel to light blue (13) and lands in the leg and does not have the treatment or remedy (e.g., anticoagulation and/or greenfield filter) then he or she must move the cell to the lung. If a player spins the wheel to light blue (13) and lands on the lung and does not have the treatment or remedy (e.g., anticoagulation), then the player loses a turn.

5. Medicine, Surgery, and Procedure Wild Cards

The Medicine, Procedure and Surgery cards are referred to as "WILD" cards (FIG. 20). In embodiments, the wilds cards have a red pathology front and a multi-colored with medicine, procedure, or surgery on the back.

These cards can be used in any color category to eradicate or treat diseases. When using these cards, each player must verbally indicate the name of the treatment, surgical intervention, and/or medicine needed to cure or manage that particular disease.

6. Goal

The goal of the game is to pass through every organ via the circulatory system to combat diseases.

In embodiments, as a player successfully passes through each organ, the player places a peg in the slot behind the card holder. For example, additional pegs corresponding to each organ, limb, or vein/artery may be on the side of the board. The additional pegs allow players to keep track of where they have passed through on the board. The player who passes through all 9 areas (leg, intestine, stomach, kidney, liver, spleen, pancreas, brain, and arm) in any order will be declared the winner of the game. As the player passes through the last organ, the player must have the cure (treatment/remedy or preventative) in order to win. If the player lacks the cure, then he or she loses a turn. The game is continued until a cure is obtained.

The exemplary and alternative embodiments described above may be combined in a variety of ways with each other. Furthermore, the steps and number of the various steps illustrated in the figures may be adjusted from that shown.

Although the present invention has been described in terms of particular exemplary and alternative embodiments, it is not limited to those embodiments. Alternative embodiments, examples, and modifications which would still be encompassed by the invention may be made by those skilled in the art, particularly in light of the foregoing teachings.

EXAMPLE GLOSSARY FOR PATHOLOGY BOOKLET

A

Adenocarcinoma—A malignant cell in the shape of alveoli from a glandular organ.

Antibiotic—A natural or synthetic substance that destroys microorganisms or inhibits their growth.

Anticholinergic—An agent that blocks parasympathetic nerve impulses.

Anticonvulsant—a medicine used to prevent or control seizures or stop an ongoing series of seizures.
Antifibrotic—A substance that causes the regression of fibrosis.
Antiinflammatory—an agent that counteracts inflammation.
Angina—Severe heart pain caused by a relative deficiency of oxygen supply to its muscle.
Amylase—A class of enzymes that splits or hydrolyze starches.
Atherosclerosis—A deposit of calcium-lipid-cholesterol in the lining of the arteries.
Atrial fibrillation—A rhythm disorder (arrhythmia) that involves a rapid heart rate in which the upper chambers are stimulated to cotract in a very disorganized and abnormal manner.
Arthritis—inflammation of a joint usually accompanied by pain, swelling, and frequently changes in structure.
Arrhythmia—An irregular heart action caused disturbances in the discharge of cardiac impulses from the sinoatrial node or ransmission through conductile tissue.
ALT—(Alanine aminotransferase) an enzyme in serum or body tissue that catalyzes the transfer of amino acid group thus allowing nitrogen to be excreted.
AST—(Aspartate Aminotransferase)—an enzyme that catalyzes the transfer of amino group forming alpha-ketoglutamic acid and aspartic acid.
Ascities—The accumulation of fluid in the peritoneal cavity.
Anticoagulants—May be referred to as blood thinners, are medications that slow the clotting of blood or prevent existing clots from enlarging.
Antigladin—An antibody used to diagnose celiac disease.
Antihypertensive drugs—An agent that prevents or controls high blood pressure.
Antiendomysiol—A stool test used to diagnose celiac disease.
Antinuclear antigen—A blood test used to measure the presence of antinuclear antibody.
Antimicrobial—An agent that prevents or destroys microoraganisms.
Antiparasitic drug—An agent that destroys parasites.
Antiretroviral—An agent used to treat HIV infection.
Angiogram—A radiographic record of the size, shape and location of the heart and blood vessels after introduction of a radiopaque contrast medium.
Amputation—The removal of a limb or part of a limb during surgery.
Aortic Stenosis—Narrowing of the aorta or its orifice due to lesions of the wall with scar tissue.
Auscultation—Listening to heart, lungs, bowel and sounds with a stethoscope.
Autoimmune—A disease produced when the body attacks normal cells whose surface contains a self antigen causing destruction of tissue.
Autologous—Transfusion of blood donated by the patient before or during surgery

B

Barrett's esophagus—Inflammation and possibly ulceration of the lower part of the esophagus caused by gastric reflux or mucosal damage due to chemotherapy.
Barium Studies—An x-ray in which a white substance is placed into the rectum and colon through the anus to enhance x-ray pictures of the large bowel.
Betablockers—Drugs that oppose the excitatory effects of norepinephine, released from sympathetic nerve endings at beta-adrenergic receptors, and used to treat angina, arrhythmia, and migraine headaches.
Biopsy—removal of part of the tissue for examination under a microscope.
Blood culture—A blood test used to determine if microorganisms such as bacteria or fungui are present in the blood.
Bronchiectasis—Chronic dilation of the bronchus or bronchi with a secondary infection that involves the lower portion of the lung.
Bronchitis—Inflammation of the mucous membrane of the bronchial airways.
Bone marrow—soft organic material that fills the cavities of the bones.
BUN—(blood urea nitrogen) found in the blood in the form of urea, the metabolic product of the breakdown of amino acids.
Bypass Graft—A means of circumvention; Installation of an alternate route for blood to pass an obstruction in the artery.

C

CABG—(coronary artery bypass graft) Surgical establishment of a shunt that permits blood to travel from the aorta to a branch of the coronary artery at the point past obstruction.
Cancer—A term used to describe malignant neoplasms marked by abnormal, rapidly growing cells.
Cardioversion—A synchronized electric shock used to terminate a cardiac arrhythmia such as atrial fibrillation.
Cardiomyopathy—Disease that weakens the heart muscle.
Carotid Endarterectomy—A surgical technique for removing intraarterial obstruction of the internal carotid artery.
Catheter—A tube passed through the body to evacuate fluids or inject them into body cavities.
CAT Scan—An x-ray to visualize organs and confirm any abnormalities.
Celiac Sprue—is an inflammatory condition caused by intolerance to gluten, a substance found in wheat or other grains.
Cellulitis—Inflammation of cellular or connective Tissue; an infection in, or close to the skin usually localized by the body's defense mechanisms.
Cholangiography—Radiography of the bile ducts.
Chemotherapy—In the treatment of disease, the application of chemical reagents that have a specific and toxic effect on the disease-causing microorganism.
Chemoprophylaxis—The use of drugs or chemicals to prevent a disease.
CHF
Circle of Willis—An arterial anastomosis located at the base of the brain which is formed by the anterior communicating, the two anterior cerebral, two internal carotid, two posterior communicating, and the two posterior cerebral arteries.
Craniotomy—A surgical opening into the skull for the removal of growth from the brain.
Creatinine—The decompensation product of the metabolism of phosphocreatine, a source of energy for muscle contraction. Increased quantities of it is found in advanced renal disease.
Colonoscopy—Examination of the colon or a colonscope.
Colostomy—An opening into a portion of the colon through the abdominal wall to bypass an intestional obstruction.
Colon resection—The removal of a segment of the large intestine (colon).
Corticosteroids—used clinically for hormonal replacement therapy; for suppression of ACTH; suppression by the anterior pituitary to suppress immune responses.
Copper Chelating—used in chemotherapeutic treatment for metal poisioning.
Cystogram—An x-ray image of the urinary bladder produced by cystography.

Cystic fibrosis—an inherited disease that causes thick sticky mucous to build up in the lungs and digestive tract. This is caused by a defective gene which tells the body to produce abnormally thick mucous.

Cytotoxic—Producing a toxic effect on cells or destruction of cells.

D

Debridement—The removal of dead or foreign tissue in a wound.

Decadron—Medication used to decrease fluids in the body.

Dialysis—The process of diffusing blood across a semi-permeable membrane to remove toxic materials and to maintain fluid, electrolyte and acid base balance in cases of impaired or absence of kidney function.

Dilated Cardiomyopathy—A disease of the heart muscle with left ventricle enlargement and heart failure.

Diuretic—An agent that increases urine secretion.

Diverticulitis—Inflammation of a diverticulum in the intestinal tract especially in the colon causing stagnation of feces in the distended sac of the colon.

Doppler Studies—A sensitive noninvasive technique for determining blood flow to an organ.

E

Echocardiogram—The graphic recording of heart sounds produced by echocardiography.

Edema—A local or generalized condition in which the body tissue contain an excessive amount of fluid.

Effusion—The escape of fluid into a part, such as the pleural cavity.

Electrocardiogram—(EKG) A record of the electrical activity of the heart.

Electrolytes—are minerals in your blood and other body fluids that carry an electric charge. It is important for the balance of electrolytes in your body to be maintained because they affect the amount of water in your body blood important processes.

Endarterectomy—Surgical removal of plaque material from the lining of an artery.

Endocarditis—Inflammation of the lining of the heart, chambers, and valves.

Endoscopic biopsy—Obtaining a tissue sample via small excision using an optical device.

Enterocolitis—Inflammation involving both the small Intestine and the colon.

ERCP—(Endoscopic Retrograde Cholangio Pancreatography) A diagnostic test used to examine the duodenum, bile ducts, gallbladder, and pancreatic ducts.

ESR—(Erythrocyte Sedimentation Rate) A non specific screening test that indirectly measures how much inflammation is in the body.

Embolectomy—Removal of an embolus from a vessel.

Embolism—Obstruction of a blood vessel by foreign substances or a blood clot.

Emphysema—Pathological distention of interstitial tissues by gas or air usually occurance in the alveoli of the lungs.

Eosinophilia—The formation and accumulation of an abnormally large number of eosinophils a type of white blood cell in the blood.

Eosinphiluria—An increased amount of eosinophils in the urine.

F

Factor 8—A protein that helps blood clot.

Fibrosis—The formation of fibrous tissue as a reparative or reactive process.

Fibrinogen—A protein synthesized by the liver and present in blood plasma that is converted to fibrin through thrombin in the presence of calcium.

Fontanelles—An unossified space or soft spot lying between the cranial bones. (seen in newborns).

G

Gangrene—Death or decay of body tissue caused by insufficient blood flow.

Gastritis—Inflammation of the lining of the stomach.

Gastrectomy—The surgical removal of part or all of the stomach.

Giardia Lamblia—An infection of the small intestine caused by the single celled protozoan parasite Giardia lamblia.

Gluten—A protein that is found in wheat or related grains and many foods we consume.

Greenfield Filter—A device that is inserted into the inferior vena cava in a folded position which springs open like an umbrella to prevent clots from migrating to major organs.

H

Haemophilus Influenza—An organism found in the respiratory tract; infections thought to be caused by a virus *H. influenza*.

Helicobacteri—A motile gram negative bacterium that causes some peptic ulcers.

Hematoma—A swelling or mass of blood confined to an organ, tissue, or space caused by a break in a blood vessel.

Hematuria—Blood in the urine.

Hepatitis—Inflammation of the liver; can be caused by infections with various organisms including bacteria, viruses, or parasites.

Hydrocephalus—An increased accumulation of cerebrospinal fluid within the ventricles of the brain.

Hypague enema—A barium enema used to demonstrate and allow for examination of the colon.

Hypercoaguability—The state of being more readily coagulated than normal which can be associated with pathological conditions.

Hypoxemia—A decreased concentration of oxygen in the blood from inspired air.

I

Ileostomy—The surgical passage through the abdominal wall into the ileum that allows fecal material to drain in a bag.

Immunosuppressant—An agent that can suppress or prevent an immune response. Used to treat autoimmune disease or prevent rejection of a transplanted organ.

Infarction—An area of tissue in an organ or part that undergoes necrosis following cessation of the blood supply.

Infection—The presence and growth of microorganisms that resist the body's defenses and cause infection.

Infiltration—The pathological accumulation in the tissue or cells or substances not normal to it or in amounts in excess of the normal.

Inflammation—The non-specific immune response that occurs in reaction to any type of bodily injury.

Insulin—A hormone that is secreted from the beta cells of the pancreas used to regulate blood sugar.

Interstitial fluid—The extracellular fluid that bathes the cells of the most tissues but which is not in the confines of the blood or lymph vessels.

Ischemia—A deficiency of blood supply due to obstruction of circulation.

L

Lactic dehydrogenase—An enzyme present in tissue and serum that is pertainent in the oxidation of lactate.

Leukemia—A malignancy of the blood forming cells in the bone marrow.

Lipase—An enzyme used to break down fats.

Lipoma—A fatty tumor.

Lobectomy—The surgical removal of a lobe of any organ or gland.

M

Malaise—A vague feeling of bodily discomfort or weakness as at the beginning of an illness.

Malignant—Growing worse, resisting treatment or threatening to produce death.

Mannitol—A diuretic used to excrete excess fluid.

Meningitis—Inflammation of the membranes of the spinal cord or brain.

Mesentery—The peritoneal fold that encircles the small intestine and connects it to the abdominal wall.

Metastasis—Movement of bacteria or body cells from one part of the body to another.

Morphine sulfate—A form of opiate used as an analgesic and sedative.

Mucosal—A mucous membrane or moist tissue that lines organs and cavities of the body.

Mucociliary—Forms a line of defense by trapping inhaled particulate matter that is swept towards the mouth of the cilia.

N

Necrosis—The death of tissue or bone caused by insufficient blood supply.

Neoplasm—A new or abnormal formation of tissue, as a tumor or growth.

Nephritis—Inflammation of the kidney

Nephrostomy—The formation of an artificial fistula into the renal pelvis.

Nephrotoxic—A toxic substance that damages the kidneys.

Nitrogylcerin—A drug used to dilate blood vessels and which is commonly used to treat angina.

Norwalk virus—A calicivirus that is the causative agent in viral gastroenteropathy.

P

Palpitation—A rapid throbbing, pulsation, or fluttering of the heart.

Pancreatic enzymes—Enzymes used to aid in the digestion of fat, carbohydrates and proteins.

Pancreatotomy—surgical incision of the pancreas.

Pancrectectomy—Surgical removal of the pancreas.

Pancreatitis—Inflammation (irritation and swelling) of the pancreas.

Paracentesis—Insertion of a needle into the abdominal cavity for the removal of fluids.

Parasite—A living organism that lives within and at the expense of another organism.

Paravovirus—A viral illness with symptoms of a blotchy rash which begins on the cheeks and spreads to the arms and legs.

Paraylsis—Temporary or permanent loss of muscular power or senation

Pericardium—A thin layer sac which encloses the heart.

Pericardial effusion—An accumulation of fluid between layers of membranes that line the heart.

Pericardiocentesis—A needle is used to aspirate the fluid from the pericardial sac that surrounds the heart.

Pericarditis—Inflammation of the pericardium, which is the sac covering the heart.

Percutaneous Aspiration—A needle biopsy used to obtain and examine tissue.

Pleural sac—A delicate membrane that surrounds the lungs.

Plaque—A yellow area on the lining of the arteries formed by lipid deposits.

Plasmodium Vivax—The causative agent for malaria.

Pluerocentesis—Also called Thoracentesis. A procedure to remove fluid from the space between the linings of the outside of the lung (pleura).

Paracentesis—Insertion of a needle into the abdominal cavity for the removal of fluids.

Pneumothorax A collection of air, (gas) in the pleural cavity.

Pneumovaccine—A preparation of a weakened strain of pneumonia that upon administration stimulates antibody production against the pathogen but is incapable of causing severe infection.

Pulmonary Eosinophilia—Inflammation of the lung associated with an increase in eosinophils, a type of white blood cell.

Pulmonary Function test—test used to determine the ability of the lungs to exchange oxygen and carbon dioxide.

Pulmonary Neoplasms—Cancerous tumors of the lung.

Pyelonephritis—Inflammation of the kidney and its pelvis.

Pyuria—Pus or white blood cells in the urine.

R

Radiation—ionizing rays used for diagnostic or therapeutic purposes.

Retroperitoneum—Space behind the peritoneum and outside the peritoneal cavity.

Retrovirus—RNA—containing tumor viruses that are oncogenic and induce sarcomas, leukemias and lymphomas.

Restrictive pulmonary function—A lung disease that is characterized by reduced lung volume and gas transfer.

Rheumatoid Factor—An immunonoglobulin present in the serum of adults with rheumatoid arthritis Rhisa scan—A nuclear scan using radioactivity which may show changes of the circulation within the brain or CSF (cerebral spinal fluid) into the ventricles.

Rubella—A mild febrile infectious viral disease common in childhood (German measles).

S

Sedimentation rate—The rate at which a sediment is digested in a given volume of solution especially when subjected to the action of centrifuge.

Seizures—A sudden attack of spasms, or convulsion or epilepsy.

Serum—The watery portion of the blood after coagulation. A fluid found when clotted blood is left standing.

Sigmoidoscopy—Use of a sigmoidoscope to inspect the sigmoid colon.

Splenectomy—Surgical excision or removal of the spleen.

Steroids—hormones that are biologically active; they are secreted by the adrenal cortex, gonads and placenta in the form of glucocorticoids, mineralocorticoids, androgens, and estrogen.

Stenosis—The constriction or narrowing of a passage or orifice.

Stool assay—A collection of stools used in diagnosis of diseases of the gastrointestional tract.

Spinal tap—(lumbar puncture)—A procedure used to collect cerebral spinal fluid to check for the presence of injury or disease Subdural hematoma—A blood clot beneath the duramater.

T

Tachycardia—An abnormal rapidity of heart action usually defined as a heart rate greater than 100 bpm.

Tamponade—A pathological condition resulting from the accumulation of excess fluid in the pericardium.

TEE—A diagnostic test (transesophageal echocardiogram) that employs ultrasound waves to make images of the heart chambers, valves, and surrounding structures.

Thallium stress test—A graded to measure an individual heart rate and oxygen intake under strenuous exercise. Thallium is used to visualize heart muscle in motion under stress.

Thoracentesis—Removal of fluid from the pleural space with a needle.

Thrombectomy—Excision of a thrombus from a blood vessel.

Thrombus—A blood clot that obstructs a blood vessel or a cavity of the heart.

Troponin—A blood test that aids in earlier diagnosis of heart attack. Specific marker for myocardial (heart) injury.

TNF—(Tumor necrosis factor)—A member of the super protein family which induces necrosis of tumor cells.

Tubular necrosis—Death of tissue due to ischemia of the tubule that transports urine to the ureter.

U

Ultrasonographic—the use of ultrasound to produce an image or photograph of an organ or tissue.

Urease—An enzyme that accelerates the hydrolysis of urea into carbon dioxide and ammonia.

V

Vasospams—Spasms of the blood vessels, resulting in diminished blood supply and/or pain.

Ventriculaopertioneal—Shunt placed to relieve intracranial pressure caused by water on the brain; this fluid is shunted from the brain into the abdominal cavity.

Ventilation perfusion—A test used to measure breathing (ventilation) and circulation (perfusion)
in all areas of the lung using a radioactive material.

Ventricular Hypertrophy—An enlargement of the ventricle of the heart increase in its size.

W

Wilson's disease—A hereditary syndrome, transmitted as an autosomal recessive trait, where there is a accumulation of copper in various organs.

I claim:

1. A method of playing a pathology board game, comprising:

providing a colored game board having 1) an illustration of the human circulatory system comprising organs, vein, artery, and limbs; and 2) a colored circle or wheel comprising a pie chart having a plurality of diseases, each disease having its own color and a number to indicate how many spaces each player moves through the illustrated circulatory system;

providing a card holder with 1) a plurality of treatment/remedy cards, wherein each treatment/remedy card comprises at least one treatment or remedy for a disease and is colored to match a corresponding disease on the colored circle; and 2) a plurality of preventative cards, wherein each preventative card comprises at least one preventative modality to prevent a disease and is colored to match a corresponding disease on the colored circle;

providing a plurality of pegs corresponding to each organ; and providing at least one pathology booklet comprising a plurality of tables, each table comprising 1) an explanation of a disease on the colored circle or wheel for at least one of an organ, vein, artery, or limb of the illustrated human circulatory system and symptoms associated with the disease; 2) a diagnostic test for the disease; 3) at least one of treatment for the disease corresponding to a treatment/remedy card, or a preventative modality for the disease corresponding to a preventative card, each player choosing a cell for circulation throughout the human circulatory system illustrated on a colored game board;

each player being dealt a plurality of treatment/remedy cards and a plurality of preventative cards;

during a turn, each player spinning the colored circle or wheel to indicate a disease and number;

advancing the cell the indicated number along the circulatory system, thereby landing on an organ, vein, artery, or limb;

locating in the at least one pathology booklet at least one of a treatment or prevention for the indicated disease corresponding to the organ, vein, artery, or limb on which the player landed;

a player matching at least one of a treatment/remedy card or preventative card corresponding to the indicated disease, thereby avoiding the disease;

as each player successfully passes through each organ, the player places a peg corresponding to the organ in a slot behind the card holder;

wherein the first player to pass through the circulatory system in any order and who has a treatment/remedy card or preventative card for the last organ is declared the winner of the game.

2. A method according to claim 1, wherein the diseases comprise edema, thrombosis, bacteria, inflammation, cancer, trauma, stenosis, emboli, ischemia, genetic, virus, parasite, necrosis, and cholesterol.

3. A method according to claim 1, wherein the organs comprise brain, lungs, heart, pancreas, liver, spleen, kidneys, stomach, and intestine.

4. A method according to claim 1, wherein the circulatory system comprises a plurality of cells spaced along its length to indicate positions for each player during play.

5. A method according to claim 1, wherein if a player lands on at least one of cholesterol, inflammation, thrombus, stenosis, or ischemia in a vein or artery, and does not have the treatment/remedy, the player spins the wheel and moves backwards the number of steps indicated on the colored circle.

6. A method according to claim 1, wherein if a player lands on at least one of the following organs and does not have the remedy for cancer, the player must move his or her cell to the corresponding organ of metastasis:

for the lung, move the cell to the brain;

for the pancreas, move the cell to the spleen or liver;

for the spleen, move the cell to the liver;

for the liver, move the cell to the lung;

for the intestine, move the cell to the liver;

for stomach, move the cell to the lung; or for the kidneys, move the cell to the liver or lung.

7. A method according to claim 1, wherein said player using a multi-color treatment/remedy card to treat a disease from a different disease category.

8. A method according to claim 1, wherein if a player lands on the disease category emboli in the heart and does not have the treatment/remedy card, the player moves the cell to the leg.

9. A method according to claim 1, wherein if a player lands on the disease category emboli in the leg and does not have the treatment/remedy card, the player moves the cell to the lung.

10. A method according to claim 1, wherein if a player lands on the disease category emboli in the lung and does not have the treatment/remedy card, the player loses a turn.

11. A method according to claim 1, further comprising each player being dealt at least one wild card comprising a medicine, procedure, or surgery card that may be used in any color category to eradicate or treat diseases.

12. A method according to claim 1, wherein the game is video game played in a graphical user interface.

* * * * *